US007707756B1

(12) United States Patent
Dinkins

(10) Patent No.: US 7,707,756 B1
(45) Date of Patent: May 4, 2010

(54) IRONING BOARD ATTACHMENT ASSEMBLY

(76) Inventor: Michael Dinkins, 2504 E. 73rd Ave., Merrillville, IN (US) 46410

( * ) Notice: Subject to any disclaimer, the term of this patent is extended or adjusted under 35 U.S.C. 154(b) by 0 days.

(21) Appl. No.: 12/323,170

(22) Filed: Nov. 25, 2008

(51) Int. Cl.
*D06F 81/12* (2006.01)
*D06F 81/10* (2006.01)

(52) U.S. Cl. ..... 38/135

(58) Field of Classification Search ..... 38/103, 38/104, 135, 140; 108/90, 94, 97; 248/117.4, 248/117.6
See application file for complete search history.

(56) References Cited

U.S. PATENT DOCUMENTS

| | | | | | |
|---|---|---|---|---|---|
| 181,813 | A | * | 9/1876 | Bagley | 108/94 |
| 28,612 | A | | 5/1898 | Rowse | |
| 955,526 | A | * | 4/1910 | Miller | 38/135 |
| 1,027,479 | A | | 5/1912 | Hoffine | |
| 1,073,814 | A | | 9/1913 | Nelson | |
| 1,731,324 | A | * | 10/1929 | Sherlock | 108/62 |
| 2,263,058 | A | * | 11/1941 | Weilert | 108/97 |
| 2,287,646 | A | * | 6/1942 | Steele | 108/99 |
| 2,888,759 | A | | 6/1959 | Vennen | |
| 2,923,077 | A | | 2/1960 | Tipping | |
| 3,176,947 | A | * | 4/1965 | Inverso | 248/117.6 |
| 3,698,110 | A | | 10/1972 | Shettel | |
| 3,967,802 | A | * | 7/1976 | Lomagno | 248/117.4 |
| 4,910,896 | A | | 3/1990 | Ruschitzka | |
| 5,016,367 | A | | 5/1991 | Breen et al. | |
| 6,151,817 | A | | 11/2000 | Eiben | |

* cited by examiner

*Primary Examiner*—Ismael Izaguirre

(57) ABSTRACT

An ironing board attachment assembly includes a clamp that is removably couplable to a panel of an ironing board. A mount is attached to the clamp and a coupler is rotationally coupled to the mount. An arm has a planar upper surface, a planar lower surface, a first end, a second end, and a pair of side edges. The first end of the arm is attached to the coupler. The arm has a longitudinal axis from the first end to the second end that is positionable at a selected angle with respect to a longitudinal axis of the panel. The arm is extendable into a shirt sleeve to allow the shirt sleeve to be ironed at a selected angle with respect to the panel.

16 Claims, 5 Drawing Sheets

IRONING BOARD ATTACHMENT ASSEMBLY

BACKGROUND OF THE INVENTION

Field of the Invention

The present invention relates to ironing board attachment devices and more particularly pertains to a new ironing board attachment device for allowing ease of ironing the sleeves of a shirt and which may also be used on pant legs.

SUMMARY OF THE INVENTION

The present invention meets the needs presented above by generally comprising a clamp that is removably couplable to a panel of an ironing board. A mount is attached to the clamp and a coupler is rotationally coupled to the mount. An arm has a planar upper surface, a planar lower surface, a first end, a second end, and a pair of side edges. The first end of the arm is attached to the coupler. The arm has a longitudinal axis from the first end to the second end that is positionable at a selected angle with respect to a longitudinal axis of the panel. The arm is extendable into a shirt sleeve to allow the shirt sleeve to be ironed at a selected angle with respect to the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
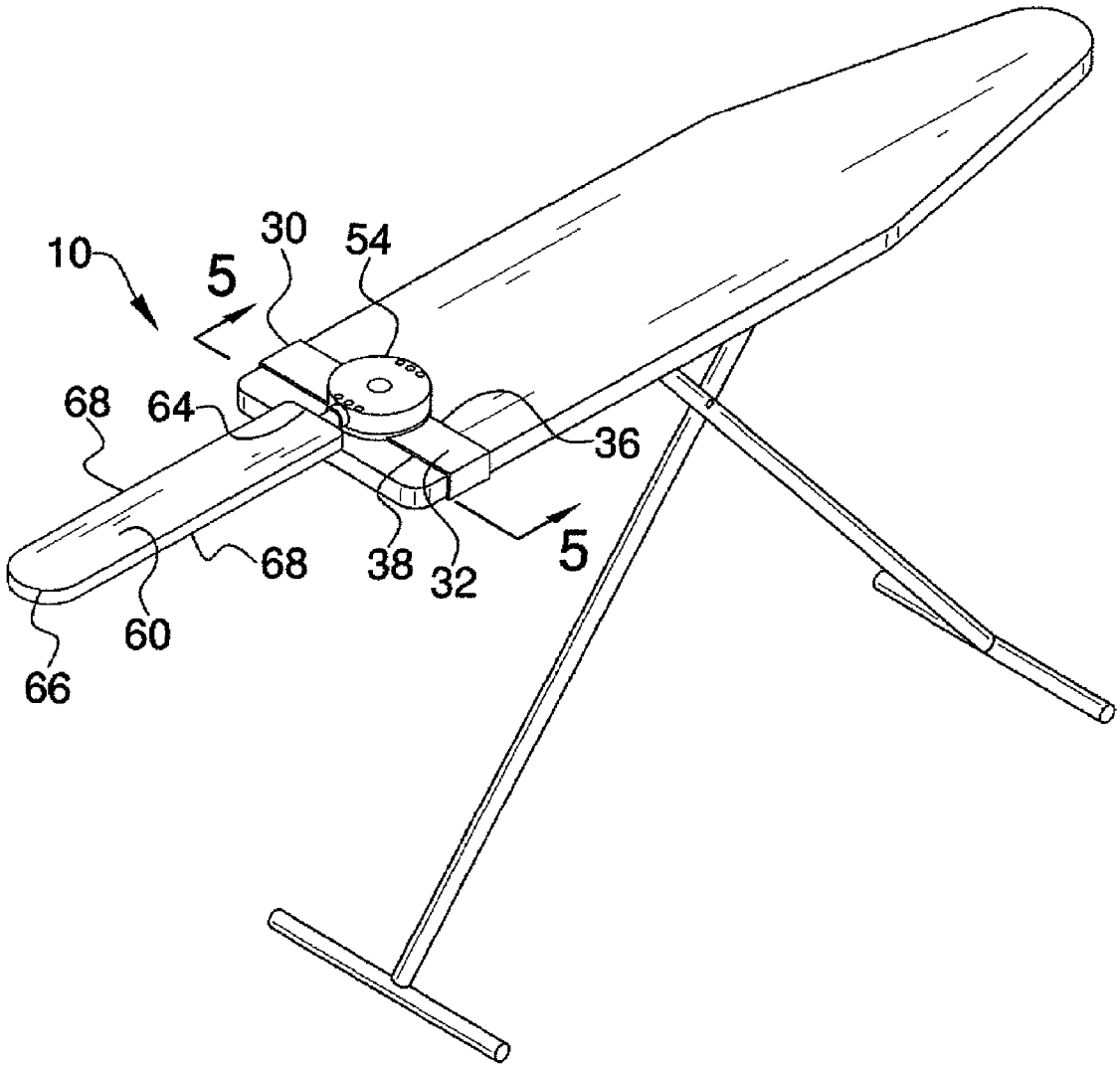
FIG. 1 is a top perspective view of a ironing board attachment assembly according to the present invention.
Figure 2:
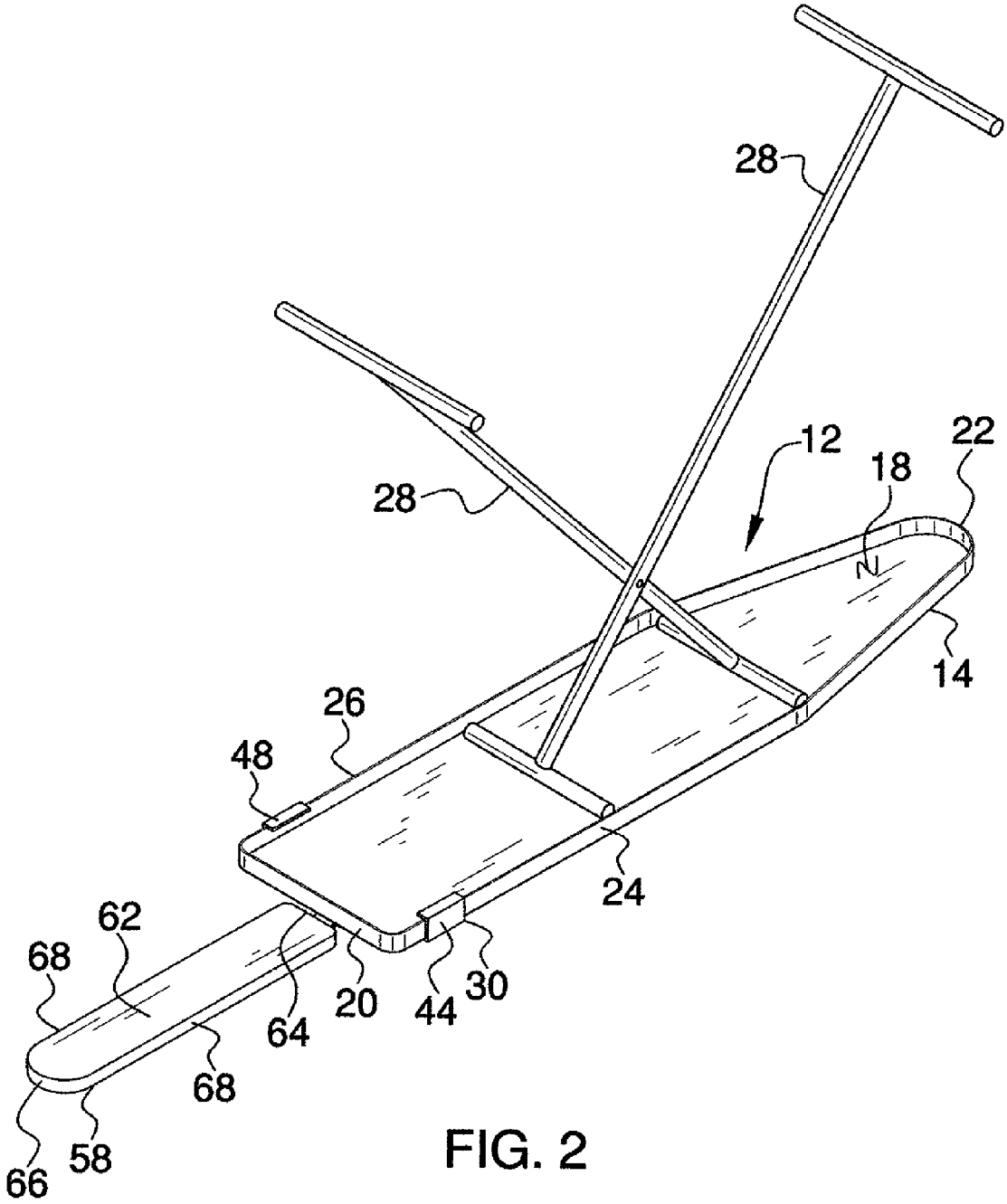
FIG. 2 is a bottom perspective view of the present invention.
Figure 3:
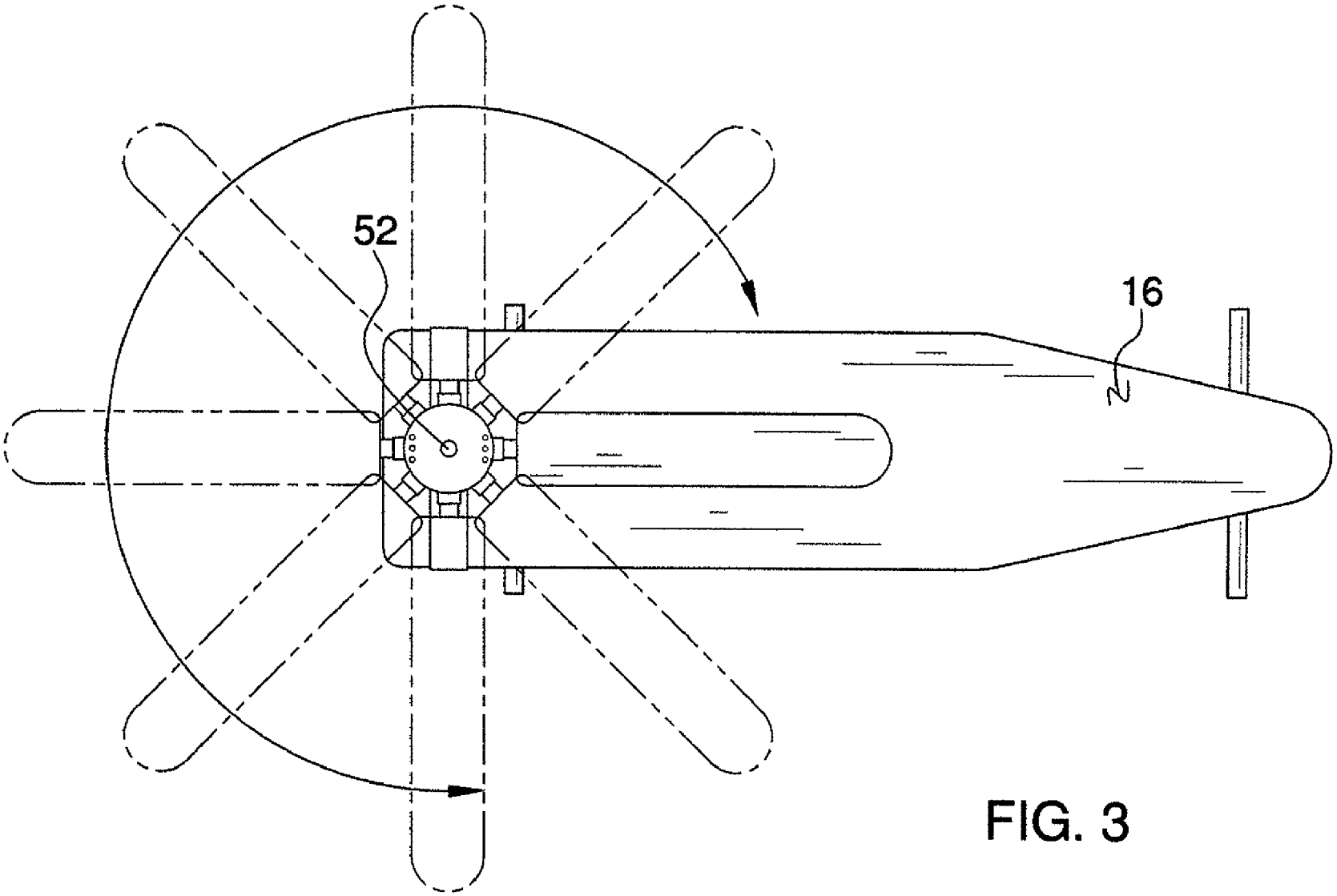
FIG. 3 is a top view of the present invention.
Figure 4:
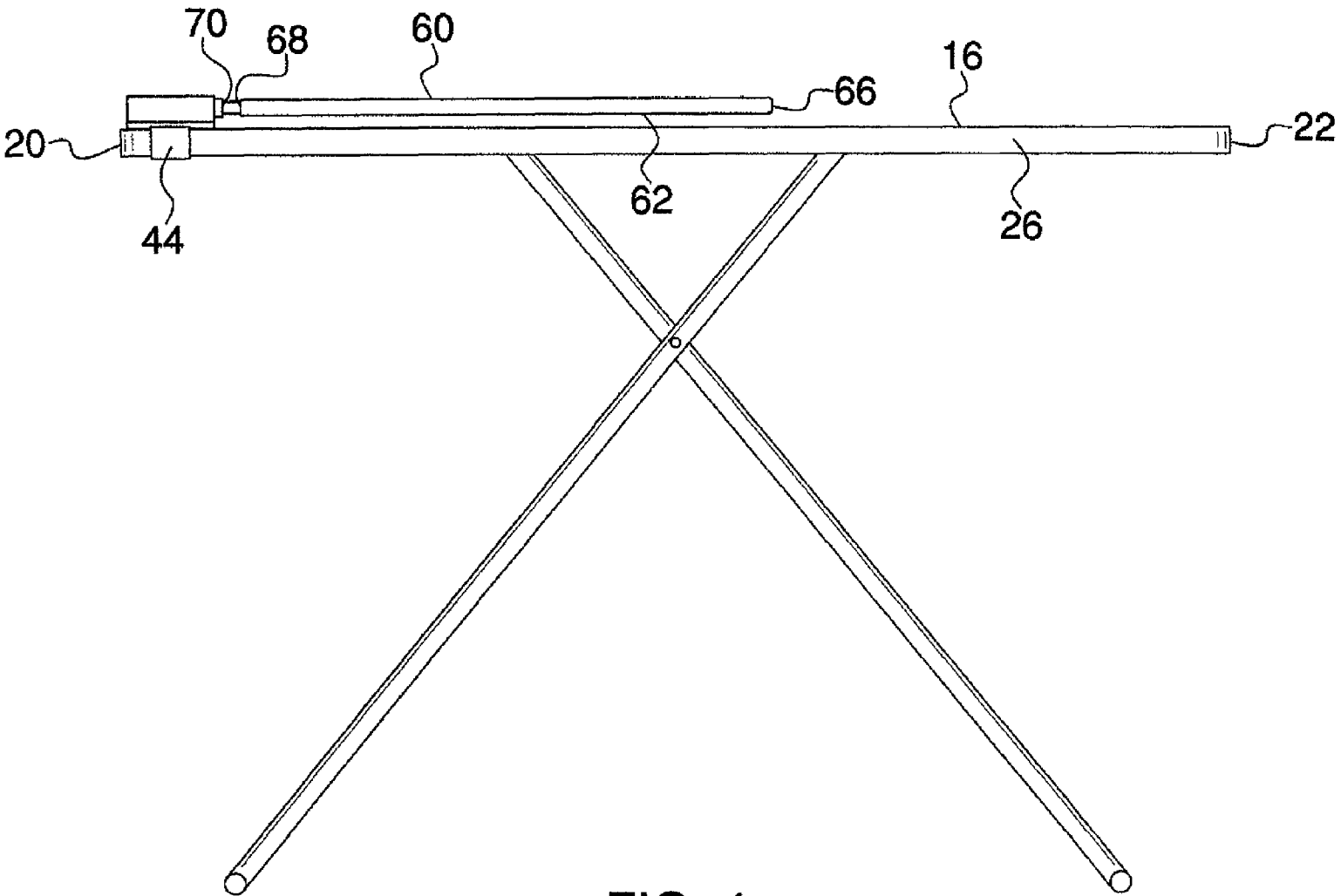
FIG. 4 is a side view of the present invention.
Figure 5:
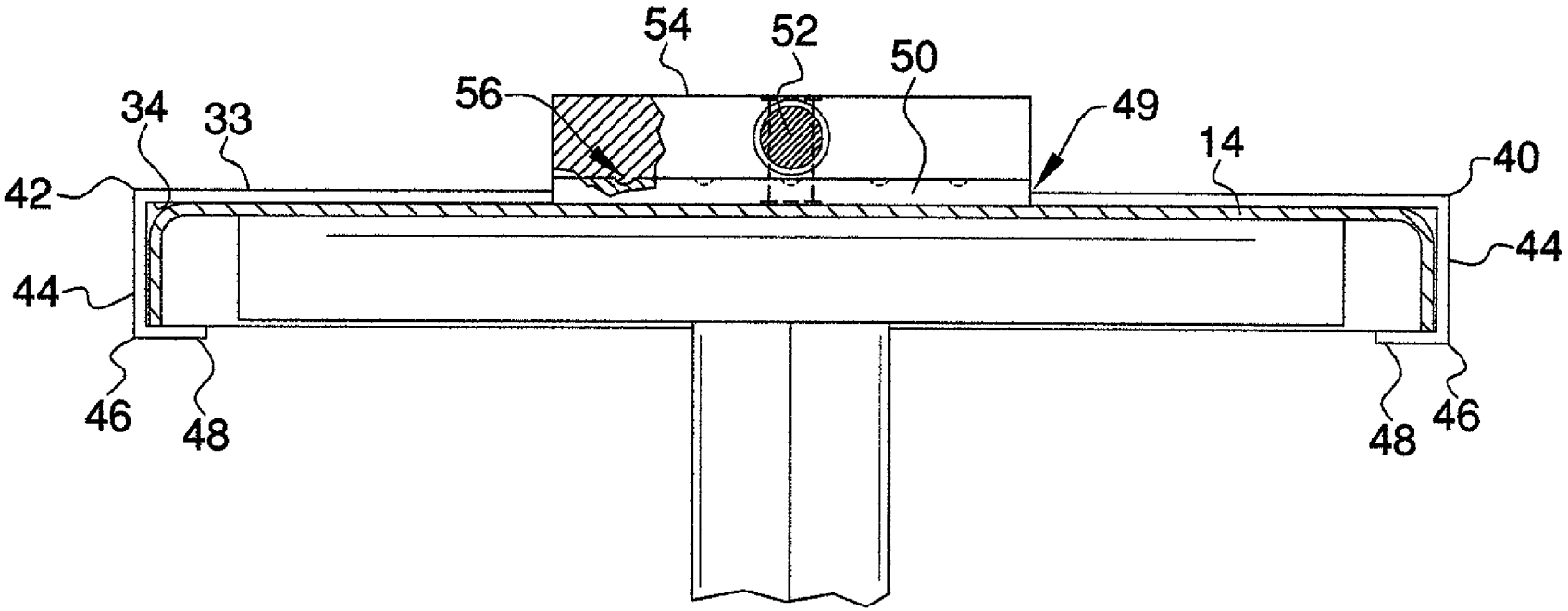
FIG. 5 is a cross-sectional view taken along line 5-5 of FIG. 1 of the present invention.

With reference now to the drawings, and in particular to FIGS. 1 through 5 thereof, a new ironing board attachment device embodying the principles and concepts of the present invention and generally designated by the reference numeral 10 will be described.

As best illustrated in FIGS. 1 through 5, the ironing board attachment assembly 10 generally comprises a device positionable on a conventional ironing board 12 that includes a panel 14 having an upper side 16 and a lower side 18. The panel 14 has first end wall 20, a second end wall 22, a first side wall 24 and a second side wall 26. The first 24 and second 26 side walls taper toward each other and the first end wall 20 is wider than the second end wall 22. A plurality of supports 28 is attached to the lower side 18.

The assembly 10 includes a clamp 30 that is removably couplable to the panel 14. The clamp 30 includes an elongated plate 32 that has a top side 33, a bottom side 34, a first lateral edge 36, a second lateral edge 38, a first end edge 40 and a second end edge 42. The plate 32 has a width from the first lateral edge 36 to the second lateral edge 38 that is less than 8 inches. A pair of legs 44 is attached to and extends downwardly from the plate 32. Each of the first 40 and second 42 end edges has one of the legs 44 attached thereto. The legs 44 have a distal end 46 with respect to the plate 32. Each of the legs 44 has a height from a corresponding one of the distal ends 46 to the plate 32 between 1 inch and 3 inches. A pair of flanges 48 is provided. Each of the distal ends 46 has one of the flanges 48 attached thereto. The flanges 48 extend toward each other. The panel 14 is positionable between the plate 32 and the flanges 48 to releasably secure the plate 32 to the panel 14.

A mount 49 is attached to the clamp 30 and includes a base wall 50 and an axle 52 engaging and extending upwardly from the base wall. A coupler 54 is rotationally coupled to the mount 49. The coupler 54 is positioned on the mount 49 and receives the axle 52. A locking member 56 is positioned on the mount 49 and the coupler 54 and resists rotation of the coupler 54 with the mount 49. The locking member 56 includes interlocking detents and nubs positioned on the coupler 54 and the mount 49 that are pushed toward each other by gravitational forces.

An arm 58 has a planar upper surface 60, a planar lower surface 62, a first end 64, a second end 66, and a pair of side edges 68. The first end 64 of the arm 58 is attached to the coupler 54 and the arm 58 has a longitudinal axis from the first end 64 to the second end 66. The longitudinal axis is positionable at a selected angle with respect to a longitudinal axis of the panel 14. The upper surface 60 may be locked in a position orientated parallel to a plane of the upper side 16 of the panel 14. However an embodiment of the invention may include the arm 58 being rotatably coupled to the coupler by a rod 70. The arm 58 has a width from between the side edges 68 between 5 inches and 10 inches and the arm 58 has length from the first end 64 to the second end 66 between 18 inches and 36 inches. The second end 66 is rounded.

In use, the ironing board 12 is used in a conventional manner except that when a shirt sleeve is to be ironed the arm 58 is extended into a shirt sleeve to provide a support on which the shirt sleeve can be ironed. The pivotable nature of the arm 58 with respect to the panel 14 allows the sleeve to be ironed at a selected angle with respect to the panel 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ironing board attachment assembly to assist a person in ironing sleeves of a shirt, said assembly being positionable on an upper side of a panel of an ironing board apparatus, said assembly comprising:

a clamp being removably couplable to the panel;

a mount being attached to said clamp;

a coupler being rotationally coupled to said mount;

an arm having a planar upper surface, a planar lower surface, a first end, a second end, and a pair of side edges, said first end of said arm being attached to said coupler by a rod, said arm being rotational with respect to coupler, said arm having a longitudinal axis from said first end to said second end, said longitudinal axis being positionable at a selected angle with respect to a longitudinal axis of the panel; and wherein said arm is extendable into a shirt sleeve to allow the shirt sleeve to be ironed at a selected angle with respect to the panel.

2. The assembly according to claim 1, wherein said clamp includes:

an elongated plate having a top side, a bottom side, a first lateral edge, a second lateral edge, a first end edge and a second end edge;

a pair of legs being attached to and extending downwardly from said plate, each of said first and second end edges having one of said legs attached thereto, each of said legs having a distal end with respect to said plate;

a pair of flanges, each of said distal ends having one of said flanges attached thereto, said flanges extending toward each other;

wherein the panel is positionable between said plate and said flanges to releasably secure said plate to said panel.

3. The assembly according to claim 1, wherein said mount includes a base wall and an axle engaging and extending upwardly from said base wall, said coupler being positioned on said mount and receiving said axle.

4. The assembly according to claim 1, wherein said arm has a width between said side edges between 5 inches and 10 inches, said arm having length from said first end to said second end between 18 inches and 36 inches.

5. The assembly according to claim 1, further including a locking member being positioned on said mount and said coupler and resisting rotation of said coupler with said mount.

6. The assembly according to claim 5, wherein said locking member includes interlocking detents and nubs positioned on said coupler and said mount, said detents and nubs being forced together by gravitational forces.

7. An ironing board attachment assembly to assist a person in ironing sleeves of a shirt, said assembly being positionable on an upper side of a panel of an ironing board apparatus, said assembly comprising:

a clamp being removably couplable to the panel, said clamp including;

an elongated plate having a top side, a bottom side, a first lateral edge, a second lateral edge, a first end edge and a second end edge, said plate having a width from said first lateral edge to said second lateral edge being less than 8 inches;

a pair of legs being attached to and extending downwardly from said plate, each of said first and second end edges having one of said legs attached thereto, each of said legs having a distal end with respect to said plate, each of said legs having a height from a corresponding one of said distal ends to said plate between 1 inch and 3 inches;

a pair of flanges, each of said distal ends having one of said flanges attached thereto, said flanges extending toward each other;

wherein the panel is positionable between said plate and said flanges to releasably secure said plate to said panel;

a mount being attached to said clamp, said mount including a base wall and an axle engaging and extending upwardly from said base wall;

a coupler being rotationally coupled to said mount, said coupler being positioned on said mount and receiving said axle;

an arm having a planar upper surface, a planar lower surface, a first end, a second end, and a pair of side edges, said first end of said arm being attached to said coupler by a rod, said arm being rotational with respect to coupler, said arm having a longitudinal axis from said first end to said second end, said longitudinal axis being positionable at a selected angle with respect to a longitudinal axis of the panel, said arm having a width between said side edges between 5 inches and 10 inches, said arm having length from said first end to said second end between 18 inches and 36 inches, said second end being rounded;

a locking member being positioned on said mount and said coupler and resisting rotation of said coupler with said mount, said locking member including interlocking detents and nubs positioned on said coupler and said mount, said detents and nubs being forced together by gravitational forces; and wherein said arm is extendable into a shirt sleeve to allow the shirt sleeve to be ironed at a selected angle with respect to the panel.

8. An attachment system for ironing a shirt sleeve, said system including:

an ironing board including a panel having an upper side and a lower side, said panel including a first end wall, a second end wall, a first side wall and a second side wall, said first and second side walls tapering toward each other and said first end wall being wider than said second end wall, a plurality of supports being attached to said lower side;

a clamp being removably coupled to said panel;

a mount being attached to said clamp;

a coupler being rotationally coupled to said mount;

an arm having a planar upper surface, a planar lower surface, a first end, a second end, and a pair of side edges, said first end of said arm being attached to said coupler by a rod, said arm being rotational with respect to coupler, said arm having a longitudinal axis from said first end to said second end, said longitudinal axis being positionable at a selected angle with respect to a longitudinal axis of the panel extending through said first and second end walls; and wherein said arm is extendable into a shirt sleeve to allow the shirt sleeve to be ironed at a selected angle with respect to the panel.

9. The system according to claim 8, wherein said clamp includes:

an elongated plate having a top side, a bottom side, a first lateral edge, a second lateral edge, a first end edge and a second end edge;

a pair of legs being attached to and extending downwardly from said plate, each of said first and second end edges having one of said legs attached thereto, each of said legs having a distal end with respect to said plate;

a pair of flanges, each of said distal ends having one of said flanges attached thereto, said flanges extending toward each other;

wherein said panel is positioned between said plate and said flanges abutted against said first and second side walls to releasably secure said plate to said panel.

10. The system according to claim 9, wherein said mount includes a base wall and an axle engaging and extending upwardly from said base wall, said coupler being positioned on said mount and receiving said axle.

11. The system according to claim 10, wherein said arm has a width between said side edges between 5 inches and 10 inches, said arm having length from said first end to said second end between 18 inches and 36 inches, said second end being rounded.

12. The system according to claim 11, further including a locking member being positioned on said mount and said coupler and resisting rotation of said coupler with said mount.

13. The system according to claim 12, wherein said locking member includes interlocking detents and nubs positioned on said coupler and said mount, said detents and nubs being forced together by gravitational forces.

14. The system according to claim 8, wherein said mount includes a base wall and an axle engaging and extending upwardly from said base wall, said coupler being positioned on said mount and receiving said axle.

15. The system according to claim 8, further including a locking member being positioned on said mount and said coupler and resisting rotation of said coupler with said mount.

16. The system according to claim 15, wherein said locking member includes interlocking detents and nubs positioned on said coupler and said mount.

* * * * *